US009659515B2

(12) United States Patent
Cho et al.

(10) Patent No.: US 9,659,515 B2
(45) Date of Patent: May 23, 2017

(54) DISPLAY DRIVER INTEGRATED CIRCUIT CHIP

(71) Applicant: Samsung Electronics Co., Ltd., Suwon-si (KR)

(72) Inventors: YoungJin Cho, Hwaseong-si (KR); HyoJoon An, Anyang-si (KR); Yun ji Hur, Hwaseong-si (KR); YounHo Hwang, Hwaseong-si (KR)

(73) Assignee: Samsung Electronics Co., Ltd. (KR)

( * ) Notice: Subject to any disclaimer, the term of this patent is extended or adjusted under 35 U.S.C. 154(b) by 41 days.

(21) Appl. No.: 14/730,006

(22) Filed: Jun. 3, 2015

(65) Prior Publication Data

US 2016/0035321 A1 Feb. 4, 2016

(30) Foreign Application Priority Data

Aug. 1, 2014 (KR) ..... 10-2014-0099123

(51) Int. Cl.

*G09G 3/36* (2006.01)
*G09G 3/20* (2006.01)
*G09G 5/36* (2006.01)

(52) U.S. Cl.

CPC ..... *G09G 3/20* (2013.01); *G09G 3/2092* (2013.01); *G09G 5/36* (2013.01); *G09G 2300/0426* (2013.01); *G09G 2310/027* (2013.01); *G09G 2310/0278* (2013.01); *G09G 2320/0276* (2013.01); *G09G 2330/028* (2013.01)

(58) Field of Classification Search

CPC ..... G09G 3/20; G09G 3/2092; G09G 3/3233; G09G 3/22; G09G 5/10; G09G 3/2074; C23C 14/0057

USPC ..... 257/288; 345/75.2, 87, 89, 204, 690

See application file for complete search history.

(56) References Cited

U.S. PATENT DOCUMENTS

| | | | | |
|---|---|---|---|---|
| 7,643,022 | B2 | 1/2010 | Kang | |
| 7,903,069 | B2 | 3/2011 | Kwon et al. | |
| 8,373,634 | B2 | 2/2013 | Jeon | |
| 2002/0063666 | A1* | 5/2002 | Kang | G09G 3/2092 345/87 |
| 2003/0210211 | A1* | 11/2003 | Moon | G09G 3/22 345/75.2 |

(Continued)

FOREIGN PATENT DOCUMENTS

| | | |
|---|---|---|
| JP | 2005-107239 | 4/2005 |
| KR | 10-2001-0019208 | 3/2001 |
| KR | 10-2008-0078361 | 8/2008 |

*Primary Examiner* — Nicholas Lee
*Assistant Examiner* — Abdul-Samad A Adediran
(74) *Attorney, Agent, or Firm* — Myers Bigel, P.A.

(57) ABSTRACT

A display driver integrated circuit chip is provided. The display driver integrated circuit chip may include a source driver circuit configured to process gamma data and generate a driving signal in response to a control signal and a clock signal, a gamma data manager circuit configured to provide the gamma data to the source driver circuit, control logic configured to provide the control signal and the clock signal to the source driver circuit, and a memory configured to store data used to operate the source driver circuit, the gamma data manager circuit and the control logic. A gamma signal line used to transmit the gamma data may include a metal line provided on an area other than an area on which the source driver circuit is disposed.

20 Claims, 11 Drawing Sheets

(56) References Cited

U.S. PATENT DOCUMENTS

| | | | | |
|---|---|---|---|---|
| 2005/0023579 | A1* | 2/2005 | Yamazaki | C23C 14/0057 257/288 |
| 2006/0208990 | A1 | 9/2006 | Kang | |
| 2007/0139349 | A1 | 6/2007 | Yoon et al. | |
| 2007/0140014 | A1 | 6/2007 | Kwon et al. | |
| 2009/0009455 | A1* | 1/2009 | Kimura | G09G 3/2074 345/89 |
| 2009/0066681 | A1 | 3/2009 | Kim et al. | |
| 2010/0060616 | A1 | 3/2010 | Shin et al. | |
| 2010/0123690 | A1 | 5/2010 | Jeon | |
| 2011/0050740 | A1* | 3/2011 | Lee | G09G 3/3233 345/690 |
| 2011/0102408 | A1 | 5/2011 | Cho et al. | |
| 2011/0175863 | A1* | 7/2011 | Shin | G09G 3/20 345/204 |
| 2011/0187755 | A1* | 8/2011 | Choi | G09G 5/10 345/690 |

* cited by examiner

DISPLAY DRIVER INTEGRATED CIRCUIT CHIP

CROSS-REFERENCE TO RELATED APPLICATIONS

The present application claims priority under 35 U.S.C. §119 to Korean Patent Application No. 10-2014-0099123, filed on Aug. 1, 2014, the entire contents of which are incorporated herein by reference.

BACKGROUND

1. Technical Field

The present disclosure relates to an integrated circuit and, more particularly, to an integrated circuit chip used to drive a display device.

2. Description of the Related Art

Many electronic devices that are widely used in recent years may include at least one integrated circuit. A size of a typical integrated circuit included in an electronic device has become smaller, as a semiconductor manufacturing process technology has been advanced. Further, various types of integrated circuits performing their own functions have been developed.

In particular, most electronic devices used in recent years may display images. For example, an electronic device, such as a cell phone, a tablet computer, a smart phone, and so on, may include a display device. A display device included in the electronic device may display the images according to driving and control of a display driver integrated circuit chip. That is, many of the electronic devices used in recent years may include the display driver integrated circuit chip in order to drive the display device.

As a demand for images having a high resolution increases, the display driver integrated circuit chip (hereinafter referred to as "DDI chip") may have a number of image signal channels. Thus, length of a longer side of the DDI chip may increase. When the length of the longer side of the DDI chip increases, length of a gamma signal line used to transmit gamma data also increases. When the length of the gamma signal line increases, resistance of the gamma signal line increases. Therefore, width of the gamma signal line needs to increase, in order to prevent the resistance of the gamma signal line from increasing. However, when the width of the gamma signal line increases, length of a shorter side of the DDI chip increases.

As the demand for images having a high resolution and a demand for a method of rapidly processing images having a large data capacity increases, an area occupied by control logic and a memory also increases. However, if the length of the shorter side of the DDI chip increases and the area occupied by the control logic and the memory increases, a production efficiency of the DDI chip is degraded.

SUMMARY

Some example embodiments of the present disclosure may provide a display driver integrated circuit chip comprising a source driver circuit configured to process gamma data and to generate a driving signal in response to a control signal and a clock signal, a gamma data manager circuit configured to provide the gamma data to the source driver circuit, the gamma data being generated based on a gamma reference signal and a gamma information signal, control logic configured to provide the control signal and the clock signal to the source driver circuit, and a memory configured to store operation data used to operate the source driver circuit, the gamma data manager circuit and the control logic. A gamma signal line used to transmit the gamma data may comprise a metal line provided on an area other than an area on which the source driver circuit is disposed.

Some embodiments of the present disclosure may provide a display driver integrated circuit chip comprising a silicon layer and two or more metal layers provided on the silicon layer. The display driver integrated circuit chip may comprise a source driver circuit configured to process gamma data, and a gamma signal line used to transmit the gamma data to the source driver circuit. The source driver circuit may comprise a first silicon area included in the silicon layer, and first metal lines included in the two or more metal layers and provided on the first silicon area. The gamma signal line may comprise second metal lines. The second metal lines may be provided on a second silicon area other than the first silicon area of the silicon layer and may be included in the two or more metal layers.

Some embodiments of the present disclosure may provide a display driver integrated circuit chip comprising a first area on which a source driver circuit is disposed, the source driver circuit being configured to process gamma data, and a second area that is not overlapped with the first area. A gamma signal line used to transmit the gamma data to the source driver circuit may comprise a metal line provided on the second area.

BRIEF DESCRIPTION OF THE DRAWINGS

The above and other aspects, features, and advantages of certain embodiments of the present disclosure will become apparent from the following detailed description with reference to the following figures, wherein like reference numerals refer to like parts throughout the various figures unless otherwise specified, and wherein.

DETAILED DESCRIPTION OF EMBODIMENTS

Figure 1:
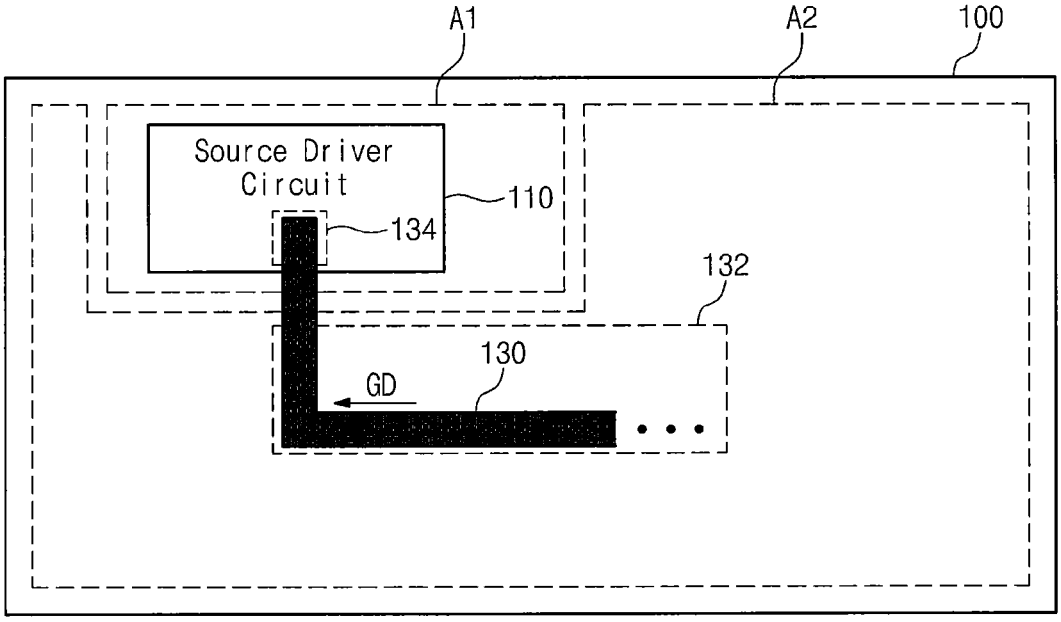
FIG. 1 is a conceptual diagram illustrating a planar view of a display driver integrated circuit chip according to some embodiments of the present disclosure.

The advantages and features of the present disclosure and methods of achieving them will be apparent from the following example embodiments that will be described in more detail with reference to the accompanying drawings. It should be noted, however, that the present disclosure is not limited to the following example embodiments, and may be implemented in various forms. Accordingly, the example embodiments are provided only to disclose the present disclosure and let those skilled in the art know the concept of the present disclosure.

In the specification, it will be understood that when an element is referred to as being "on" another layer or substrate, it can be directly on the other element, or intervening elements may also be present. In the drawings, thicknesses of elements are exaggerated for clarity of illustration.

Example embodiments of the present disclosure will be described below with reference to cross-sectional views, which are exemplary drawings of the present disclosure. The exemplary drawings may be modified by manufacturing techniques and/or tolerances. Accordingly, the example embodiments of the present disclosure are not limited to specific configurations shown in the drawings, and include modifications based on the method of manufacturing the semiconductor device. Regions or areas shown in the drawings have schematic characteristics. In addition, the shapes of the regions shown in the drawings exemplify specific shapes of regions in an element, and do not limit the present disclosure. Though terms like a first, a second, and a third are used to describe various elements in various example embodiments of the present disclosure, the elements are not limited to these terms. These terms are used only to tell one element from another element. An embodiment described and exemplified herein includes a complementary embodiment thereof.

The terms used in the specification are for the purpose of describing particular embodiments only and are not intended to be limiting of the present disclosure. As used in the specification, the singular forms "a", "an" and "the" are intended to include the plural forms as well, unless the context clearly indicates otherwise. It will be further understood that the terms "comprises" and/or "comprising", when used in the specification, specify the presence of stated features, integers, steps, operations, elements, and/or components, but do not preclude the presence or addition of one or more other features, integers, steps, operations, elements, components, and/or groups thereof.

Hereinafter, example embodiments of the present disclosure will now be described more fully with reference to accompanying drawings.

FIG. 1 is a conceptual diagram illustrating a planar view of a display driver integrated circuit chip (hereinafter referred to as "DDI chip") 100 according to some embodiments of the present disclosure. Referring to FIG. 1, the DDI chip 100 may include a first area A1 and a second area A2.

The DDI chip 100 may include a source driver circuit 110. The source driver circuit 110 may be disposed on the first area A1. The source driver circuit 110 may process data corresponding to an image to be displayed on a display device. In particular, the source driver circuit 110 may process gamma data GD. The source driver circuit 110 will be further described later with reference to FIGS. 3, 6, and 7.

The second area A2 is an area not overlapped with the first area A1. One or more components, other than the source driver circuit 110, of the DDI chip 110 may be disposed on the second area A2. The other components of the DDI chip 110 may be further described later with reference to FIGS. 5, 8, and 10.

Further, a gamma signal line 130 may be provided in the DDI chip 100. The gamma signal line 130 may be used to transmit the gamma data GD to the source driver circuit 110. In particular, according to some embodiments of the present disclosure, the gamma signal line 130 may include a metal line 132 provided on the second area A2.

If, unlike the example embodiment of the present disclosure, the whole gamma signal line 130 is disposed on the first area A1 on which the source driver circuit 110 is disposed, the first area A1 may increase. In particular, since the gamma signal line 130 transmits the gamma data GD associated with red color, green color, and blue color of each of all output pads, an area occupied by the gamma signal line 130 may be significantly large. For this reason, if the whole gamma signal line 130 is disposed on the first area A1, a production efficiency of the DDI chip 100 may be degraded.

However, according to the example embodiment of the present disclosure, most of the gamma signal line 130 may be provided on the second area A2. In particular, the gamma signal line 130 may include the metal line 132, which is provided on the second area A2 and does not have another use. Thus, the first area A1 may decrease, and height of the source driver circuit 110 may decrease. When the height of the source driver circuit 110 decreases, length of a shorter side of the DDI chip 100 may decrease. As a result, a production efficiency of the DDI chip 100 may be improved.

Further, as an example embodiment, the gamma signal line 130 may include a metal line 134 provided on the first area A1. That is, the gamma signal line 130 may be provided on the first area A1 and the second area A2. In this example embodiment, the gamma data GD may be provided to the source drive circuit 110 along the metal line 132 disposed on the second area A2 and along the metal line 134 disposed on the first area A1.

However, FIG. 1 is just a conceptual diagram to help understanding of the configuration of the DDI chip 100. The arrangement of each area and the shape of each component may be variously changed or modified, as necessary. FIG. 1 is not intended to limit the configuration of the DDI chip 100.

Figure 2:
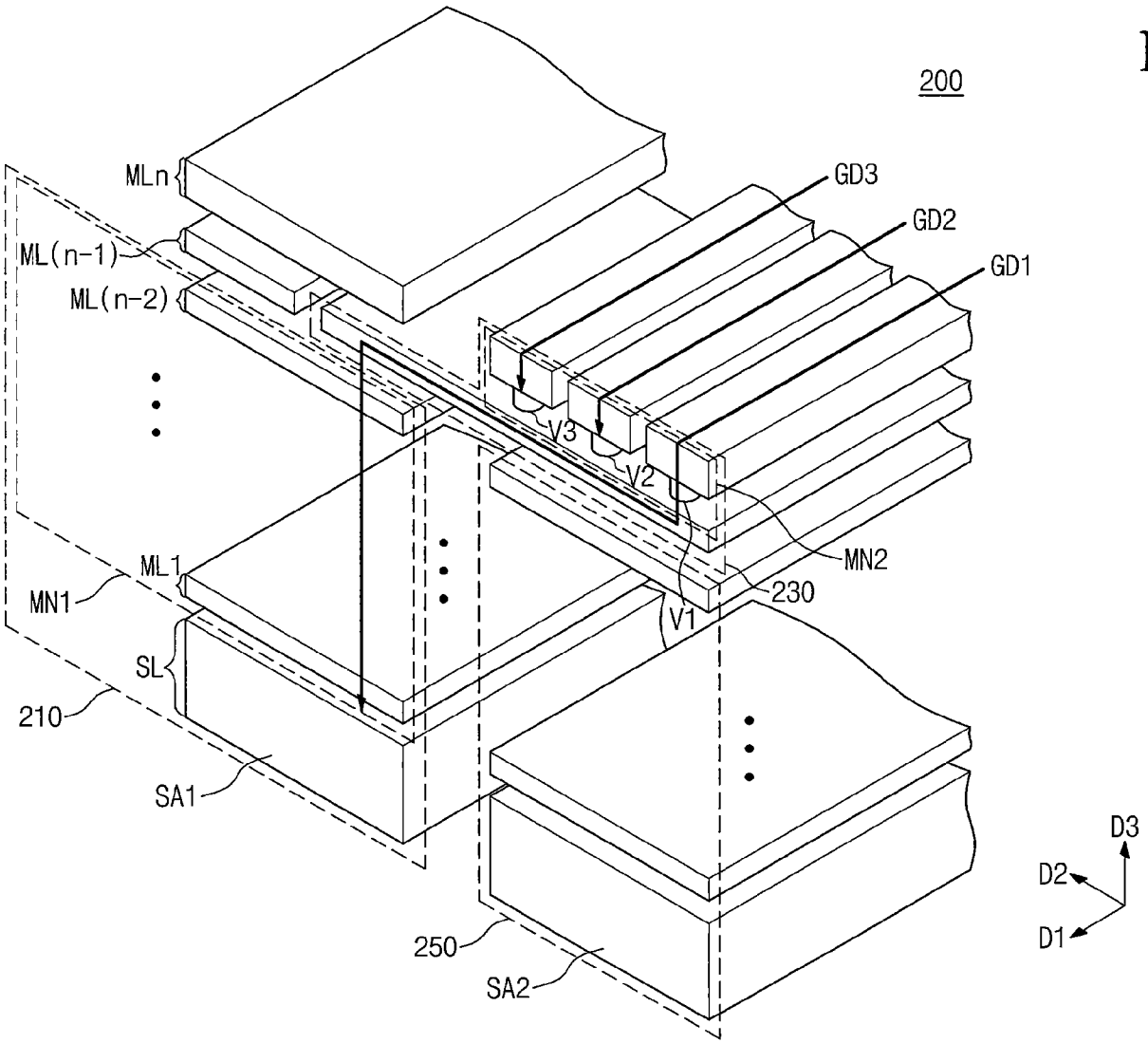
FIG. 2 is a conceptual diagram illustrating a cross-sectional view of a display driver integrated circuit chip according to some embodiments of the present disclosure.

FIG. 2 is a conceptual diagram illustrating a cross-sectional view of a DDI chip 200 according to some embodiments of the present disclosure. FIG. 2 may correspond to a cross-sectional view of a DDI chip 100 shown in FIG. 1. Referring to FIG. 2, the DDI chip 200 may include a silicon layer SL and two or more metal layers ML1 to MLn. The two or more metal layers ML1 to MLn may be provided on the silicon layer SL. The silicon layer SL and the two or more metal layers ML1 to MLn may be stacked in a third direction D3.

A specific silicon area included in the silicon layer SL may be configured to perform an intrinsic function together with specific metal lines included in the two or more metal layers ML1 to MLn. In addition, lines are appropriately connected between the two or more metal layers ML1 to MLn, and, thus, signals used to perform an intrinsic function may be transmitted along the connected lines.

As described with reference to FIG. 1, the DDI chip 200 may include a source driver circuit 210. The source driver circuit 210 may include a first silicon area SA1. In addition, the source driver circuit 210 may include first metal lines MN1, which are provided on the first silicon area SA1 and are included in the two or more metal layers ML1 to MLn. For instance, the first metal lines MN1 may include metal lines included in a first metal layer ML1 to an $(n-2)^{th}$ metal layer ML(n−2). The first silicon area SA1 may be configured to perform a function of the source driver circuit 210 together with the first metal lines MN1. Referring to FIGS. 1 and 2, the first silicon area SA1 and the first metal lines MN1 may be disposed on the first area A1 shown in FIG. 1.

As described with reference to FIG. 1, the DDI chip 200 may include a gamma signal line 230. The gamma signal line 230 may include second metal lines MN2, which are provided on a second silicon area SA2 and are included in the two or more metal layers MN1 to MLn. The second silicon area SA2 is an area other than the first silicon area SA1. For instance, referring to FIGS. 1 and 2, the second silicon area SA2 may be disposed on the second area A2 shown in FIG. 1.

As an example embodiment, the second metal lines MN2 may include a metal line of the uppermost metal layer (i.e., the $n^{th}$ metal layer MLn) that is farthest away from the silicon layer SL among the two or more metal layers ML1 to MLn. In addition, the second metal lines MN2 may include a metal line of the next upper metal layer (i.e., the $(n-1)^{th}$ metal layer ML(n−1)) that is closest to the uppermost metal layer MLn. In this example embodiment, the metal line of the uppermost metal layer MLn may be connected to the metal line of the next upper metal layer ML(n−1) through vias V1 to V3. Referring to FIGS. 1 and 2, the metal line of the uppermost metal layer MLn and the metal line of the next upper metal layer ML(n−1), which are included in the second metal lines MN2, may correspond to the metal line 132 provided on the second area A2 shown in FIG. 1.

As an example embodiment, the gamma signal line 230 may further include a metal line which is provided on the first silicon area SA1 and is included in the next upper metal layer ML(n−1). Referring to FIGS. 1 and 2, the metal line provided on the first silicon area SA1 and included in the next upper metal layer ML(n−1) may correspond to the metal line 134 disposed on the first area A1.

That is, referring to FIG. 2, the gamma signal line 230 may include the metal line that is provided on the second silicon area SA2 and is included in the uppermost metal layer MLn, the metal line that is provided on the second silicon area SA2 and is included in the next upper metal layer ML(n−1), and the metal line that is provided on the first silicon area SA1 and is included in the next upper metal layer ML(n−1). Accordingly, gamma data GD (see FIG. 1) may be transmitted to the source driver circuit 210 along the metal line that is provided on the second silicon area SA2 and is included in the uppermost metal layer MLn, the vias V1 to V3, the metal line that is provided on the second silicon area SA2 and is included in the next upper metal layer ML(n−1), and the metal line that is provided on the first silicon area SA1 and is included in the next upper metal layer ML(n−1).

For instance, the gamma data GD may include first gamma data GD1, second gamma data GD2, and third gamma data GD3. As an example embodiment, the first gamma data GD1 may be gamma data associated with red color, the second gamma data GD2 may be gamma data associated with green color, and the third gamma data GD3 may be gamma data associated with blue color.

As illustrated in FIG. 2, the metal line that is provided on the second silicon area SA2 and is included in the uppermost metal layer MLn may include multiple lines separately provided from one another. The multiple lines may transmit the first gamma data GD1 to the third gamma data GD3, respectively. In this example embodiment, the multiple lines may be connected to the metal line included in the next upper metal layer ML(n−1) through the vias V1 to V3, respectively. In this example embodiment, the first gamma data GD1 may be transmitted to the source driver circuit 210 through the via V1, the second gamma data GD2 may be transmitted to the source driver circuit 210 through the via V2, and the third gamma data GD3 may be transmitted to the source driver circuit 210 through the via V3.

As an example embodiment, the first gamma data GD1 to the third gamma data GD3 may be transmitted in a first direction D1 through the metal line that is provided on the second silicon area SA2 and is included in the uppermost metal layer MLn. Then, the first gamma data GD1 to the third gamma data GD3 may be transmitted in a second direction D2 through the metal line that is provided on the second silicon area SA2 and is included in the next upper metal layer ML(n−1).

As an example embodiment, the metal line that is provided on the first silicon area SA1 and is included in the next upper metal layer ML(n−1) may be connected to the first metal lines MN1 through an additional via (not shown). Thus, the first gamma data GD1 to the third gamma data GD3 may be transmitted to the source driver circuit 210 through the gamma signal line 230.

The DDI chip 200 may further include other components 250 other than the source driver circuit 210. The components 250 may include portions of the second silicon area SA2. In addition, the components 250 may include portions of the metal lines that are provided on the second silicon area SA2 and are included in the first metal layer ML1 to the $(n-2)^{th}$ metal layer ML(n−2). The second silicon area SA2 may be configured to perform intrinsic functions of the components 250 together with the metal lines that are provided on the second silicon area SA2 and are included in the first metal layer ML1 to the $(n-2)^{th}$ metal layer ML(n−2). The components 250 may be further described later with reference to FIGS. 5, 8, and 10.

According to some embodiments of the present disclosure, the gamma signal line 230 may include a metal line that is provided on an area other than an area on which the source driver circuit 210 is disposed. In particular, the gamma signal line 230 may include the second metal lines MN2 that are provided on the second silicon area SA2 and are not used for another purpose. That is, the gamma signal line 230 may include not only the metal lines provided on the first silicon area SA1, but also the metal lines provided on the second silicon area SA2. Thus, the area on which the source driver circuit 210 is disposed may decrease, and a production efficiency of the DDI chip 200 may be improved.

However, FIG. 2 is just a conceptual diagram to help understanding of the configuration of the DDI chip 200. The arrangements, shapes, structures, the number of the silicon layer SL, the two or more metal layers ML1 to MLn, connections between the two or more metal layers ML1 to MLn, and configurations of the source driver circuit 210, the gamma signal line 230 and the components 250 may be variously changed or modified, as necessary. FIG. 2 is not intended to limit the configuration of the DDI chip 200.

Figure 3:
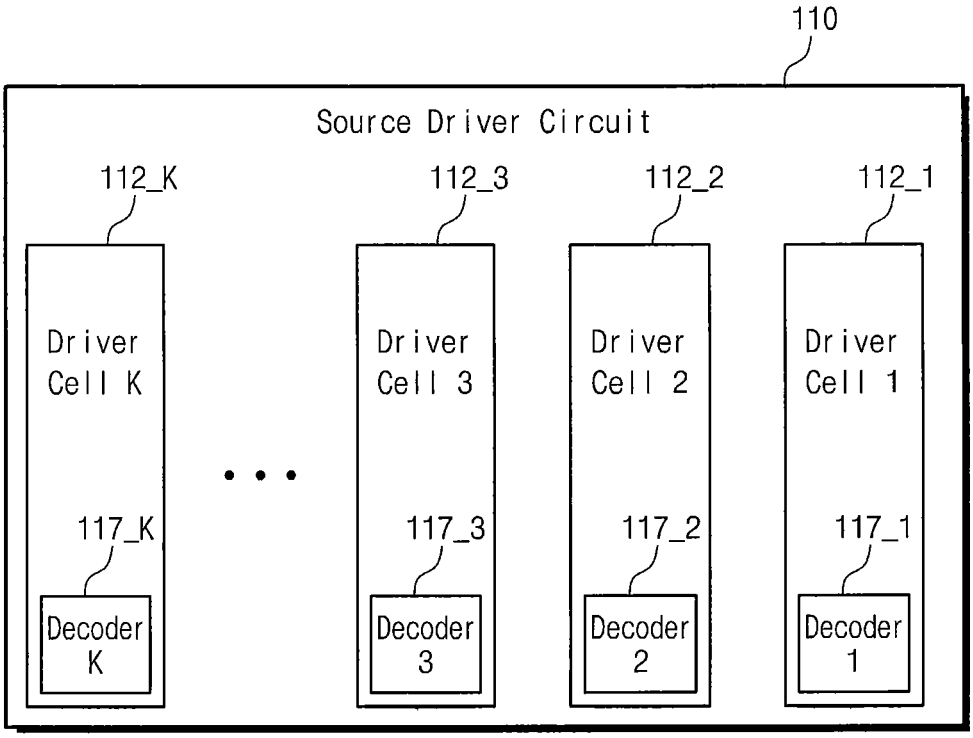
FIG. 3 is a block diagram illustrating a source driver circuit shown in FIG. 1 according to some embodiments of the present disclosure.

FIG. 3 is a block diagram illustrating a source driver circuit 110 shown in FIG. 1 according to some embodiments of the present disclosure. Referring to FIG. 3, the source driver circuit 110 may include a plurality of driver cells 112_1 to 112_K. The driver cells 112_1 to 112_K may include decoders 117_1 to 117_K, respectively.

As described with reference to FIG. 1, the source driver circuit 110 may process gamma data. The source driver circuit 110 may include the driver cells 112_1 to 112_K that are respectively corresponding to a plurality of pixel columns of a display device, in order to process the gamma data associated with each of the plurality of pixel columns of the display device. For instance, a first driver cell 112_1 may include a first decoder 117_1.

For instance, the first decoder 117_1 may receive a control signal. As an example embodiment, the control signal may be provided from control logic. The first decoder 117_1 may process the gamma data corresponding to a driving signal in order to be output from the first driver cell 112_1. The first decoder 117_1 may process the gamma data based on the control signal. Redundant descriptions associated with the decoders 117_2 to 117_K will be omitted below for brevity of the description.

Based on the gamma data processed by the decoders 117_1 to 117_K, the drivers cells 112_1 to 112_K may output driving signals that are respectively corresponding to the plurality of pixel columns. Thus, the source driver circuit 110 may process data corresponding to an image that is to be displayed on the display device. The source driver circuit 110 will be further described later with reference to FIGS. 6 and 7.

Figure 4:
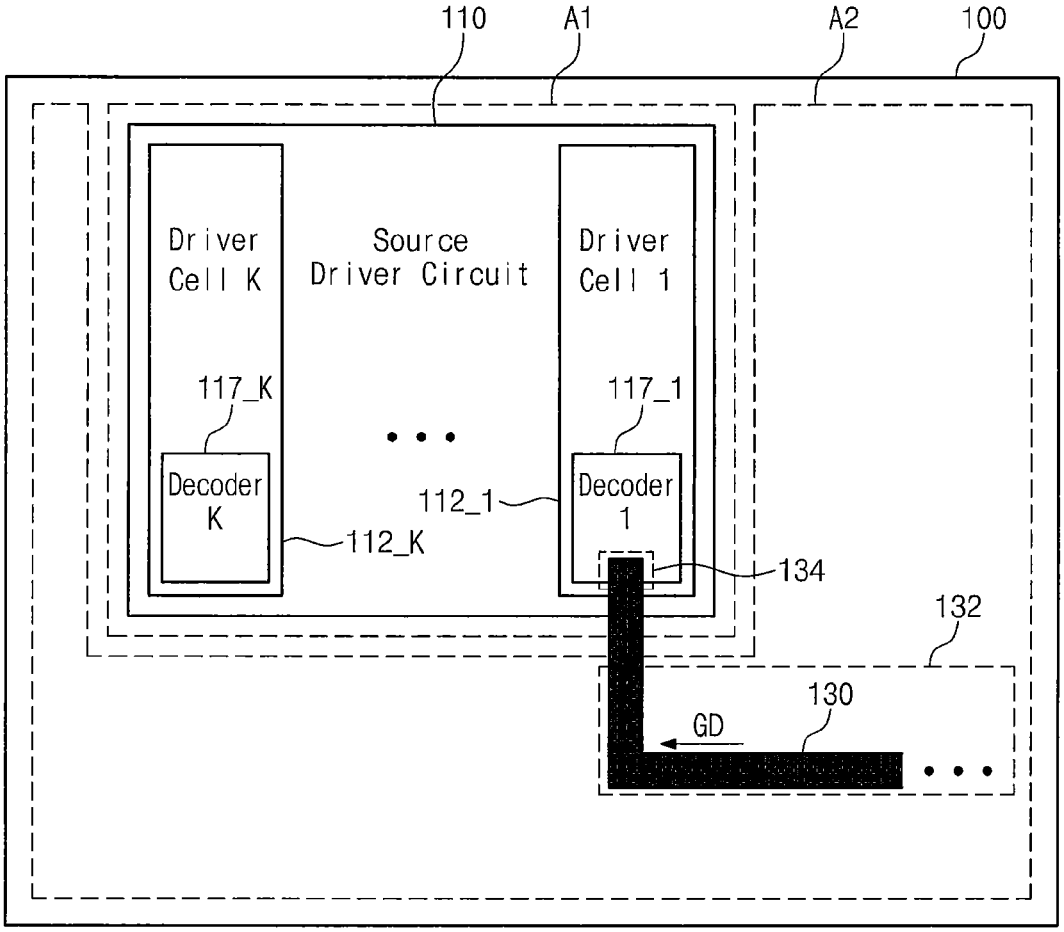
FIG. 4 is a conceptual diagram illustrating a planar view of a display driver integrated circuit chip according to some embodiments of the present disclosure.

FIG. 4 is a conceptual diagram illustrating a planar view of a DDI chip 100 according to some embodiments of the present disclosure. In particular, FIG. 4 shows a case that the DDI chip 100 of FIG. 1 includes the source driver circuit 110 shown in FIG. 3. Therefore, detailed descriptions duplicated with the descriptions for FIGS. 1 and 3 will be omitted below for brevity of the description. Referring to FIG. 4, the DDI chip 100 may include a first area A1 and a second area A2.

The source driver circuit 110 may be disposed on the first area A1. The source driver circuit 110 may include a plurality of driver cells 112_1 to 112_K. As an example embodiment, decoders 117_1 to 117_K that are respectively included in the driver cells 112_1 to 112_K may be disposed adjacent to the second area A2.

When the decoders 117_1 to 117_K are disposed adjacent to the second area A2, a distance between each of the decoders 117_1 to 117_K and a metal line 132 provided on the second area A2 may be shortened. Thus, according to the above example embodiment, an area occupied by the metal line 134 provided on the first area A1 among the gamma signal line 130 may be minimized. As a result, when the decoders 117_1 to 117_K are disposed adjacent to the second area A2, the first area A1 may decrease and height of the source driver circuit 110 may also decrease.

However, FIG. 4 is just a conceptual diagram to help understanding of the configuration of the DDI chip 100. FIG. 4 is not intended to limit the configuration of the DDI chip 100. The DDI chip 110 may have a different configuration from that shown in FIG. 4.

Figure 5:
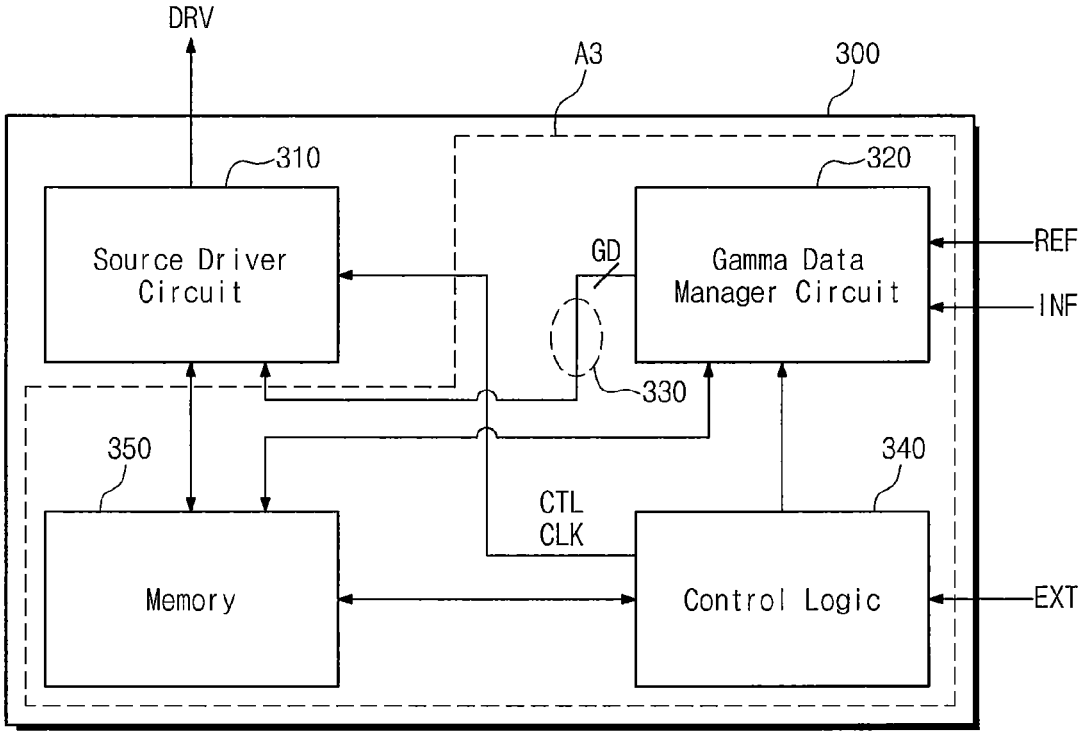
FIG. 5 is a block diagram illustrating a display driver integrated circuit chip according to some embodiments of the present disclosure.

FIG. 5 is a block diagram illustrating a DDI chip 300 according to some embodiments of the present disclosure. Referring to FIG. 5, the DDI chip 300 may include a source driver circuit 310, a gamma data manager circuit 320, control logic 340, and a memory 350. The DDI chip 300 of FIG. 5 may correspond to the DDI chip 100 of FIG. 1 or to the DDI chip 200 of FIG. 2. The source driver circuit 310 of FIG. 5 may correspond to the source driver circuit 110 of FIG. 1 or to the source driver circuit 210 of FIG. 2.

The source driver circuit 310 may receive a control signal CTL and a clock signal CLK. The source driver circuit 310 may process gamma data GD in response to the control signal CTL and the clock signal CLK. Thus, the source driver circuit 310 may generate a driving signal DRV. The generated driving signal DRV may be provided to a display device. The display device may display an image based on the driving signal DRV output from the source driver circuit 310.

The gamma data manager circuit 320 may receive a gamma reference signal REF and a gamma information signal INF. As an example embodiment, the gamma reference signal REF and the gamma information signal INF may be received from an exterior of the DDI chip 300 through an input pad. The gamma data manager circuit 320 may generate the gamma data GD used to display an image, based on the gamma reference signal REF and the gamma information signal INF. For instance, the gamma data manager circuit 320 may compare a voltage value of the gamma reference signal REF with a voltage value of the gamma information signal INF, and may generate the gamma data GD having a value which varies depending on a result of the comparison. The gamma data manager circuit 320 may provide the generated gamma data GD to the source driver circuit 310.

The gamma data GD may be transmitted through a gamma signal line 330. As described with reference to FIGS. 1 and 2, in some embodiments of the present disclosure, the gamma signal line 330 may include a metal line provided on an area other than an area on which the source driver circuit 310 is disposed. For instance, the gamma signal line 330 may include a metal line provided on a third area A3 which is an area where the source driver circuit 310 is not disposed.

Referring to FIGS. 1 and 5, the third area A3 shown in FIG. 5 may correspond to the second area A2 shown in FIG. 1. Referring to FIGS. 2 and 5, the third area A3 shown in FIG. 5 may correspond to an area on the second silicon area SA2 shown in FIG. 2. That is, the gamma signal line 330 may include a metal line provided on the third area A3 that is not overlapped with the area on which the source driver circuit 310 is disposed.

As an example embodiment, the metal line provided on the third area A3 may be provided on an area on which the memory 350 is disposed. That is, referring to FIGS. 2 and 5, the components 250 of FIG. 2 may include the memory 350 of FIG. 5. In this example embodiment, the gamma data GD may be transmitted through the metal line provided on the area on which the memory 350 is disposed. This example embodiment will be further described later with reference to FIG. 9.

As described with reference to FIGS. 1 and 2, according to some embodiments of the present disclosure, most of the gamma signal line 330 may be disposed on the third area A3. In particular, the gamma signal line 330 may includes a metal line which is disposed on the third area A3 and is not used for another purpose. Thus, height of the source driver circuit 310 may decrease, and a shorter side of the DDI chip 300 may decrease. As a result, a production efficiency of the DDI chip 300 may be improved.

As an example embodiment, the gamma signal line 330 may further include a metal line provided on the area on which the source driver circuit 310 is disposed. That is, the gamma signal line 330 may be provided on the area on which the source driver circuit 310 is disposed and provided on the third area A3. Thus, the gamma data GD may be transmitted to the source driver circuit 310 along the metal line provided on the third area A3 and along the metal line provided on the area on which the source driver circuit 310 is disposed. This example embodiment has been described with reference to FIG. 1.

The control logic 340 may control the overall operations of the DDI chip 300. In particular, the control logic 340 may provide the control signal CTL and the clock signal CLK to the source driver circuit 310. As an example embodiment, the control logic 340 may operate based on an external control signal EXT.

The memory 350 may store data used to operate the DDI chip 300. The memory 350 may also store data used to operate at least one of the source driver circuit 310, the gamma data manager circuit 320, and the control logic 340. For instance, the memory 350 may be a static random access memory (SRAM) or a dynamic random access memory (DRAM), which operates at high speed. However, as necessary, the memory 350 may further include a nonvolatile memory, such as a flash memory, a phase-change RAM (PRAM), a magneto-resistive RAM (MRAM), a resistive RAM (ReRAM), and a ferro-electric RAM (FRAM). Alternatively, the memory 350 may include a heterogeneous type of memories.

Figure 6:
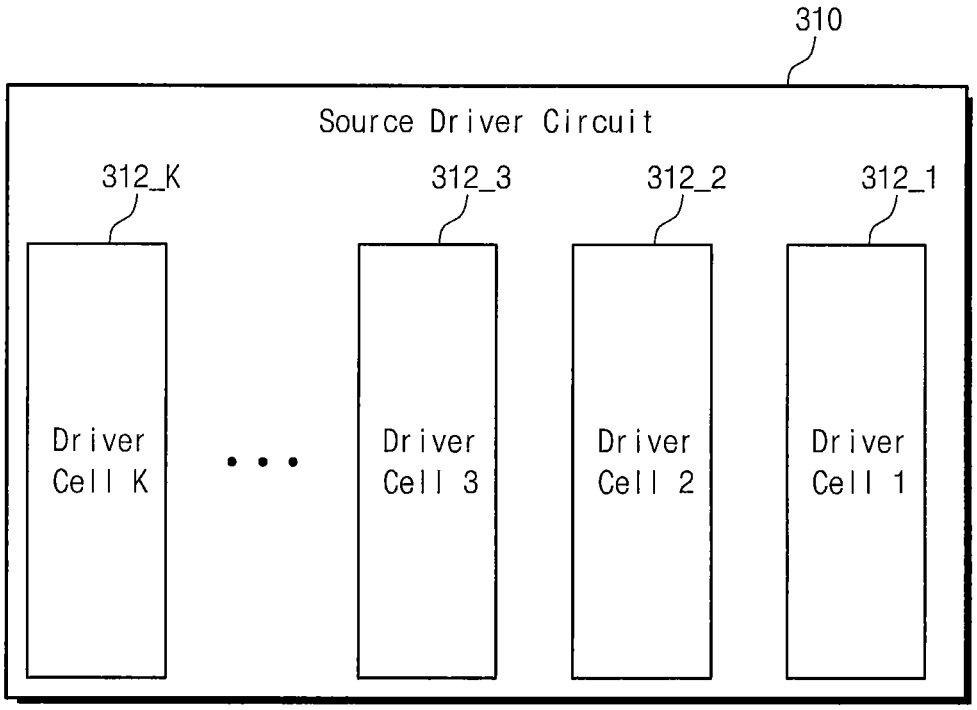
FIG. 6 is a block diagram illustrating a source driver circuit shown in FIG. 5 according to some embodiments of the present disclosure.

FIG. 6 is a block diagram illustrating a source driver circuit 310 shown in FIG. 5 according to some embodiments of the present disclosure. Referring to FIG. 6, the source driver circuit 310 may include a plurality of driver cells 312_1 to 312_K.

As described with reference to FIG. 5, the source driver circuit 310 may process gamma data. The source driver circuit 310 may include the driver cells 312_1 to 312_K that are respectively corresponding to a plurality of pixel columns of a display device, in order to process the gamma data associated with each of the pixel columns. Among the driver cells 312_1 to 312_K, an example configuration of a first driver cell 312_1 will be described below with reference to FIG. 7. The other driver cells 312_2 to 312_K may be configured similarly to the first driver cell 312_1, and, thus, redundant descriptions associated with the driver cells 312_2 to 312_K will be omitted below for brevity for the description.

Figure 7:
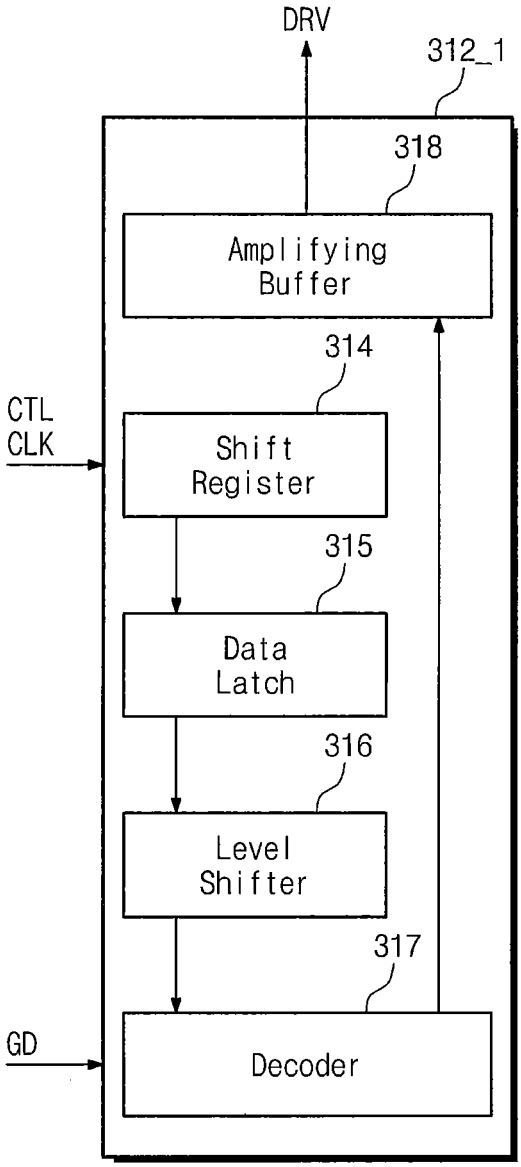
FIG. 7 is a block diagram illustrating a driver cell shown in FIG. 6 according to some embodiments of the present disclosure.

FIG. 7 is a block diagram illustrating a first driver cell 312_1 shown in FIG. 6 according to some embodiments of the present disclosure. Referring to FIG. 7, the first driver cell 312_1 may include a shift register 314, a data latch 315, a level shifter 316, a decoder 317, and an amplifying buffer 318. The first driver cell 312_1 may receive a control signal CTL and a clock signal CLK from control logic 340 (see FIG. 5). In addition, the first driver cell 312_1 may receive gamma data GD from a gamma data manager circuit 320 (see FIG. 5).

The shift register 314 may sequentially output bits included in the control signal CTL in response to the clock signal CLK. The bits that are sequentially output from the shift register 314 may be provided to the data latch 315. The data latch 315 may latch the bits that are sequentially output from the shift register 314 in response to the clock signal CLK. The bits latched by the data latch 315 may be provided to the level shifter 316. The level shifter 316 may adjust signal levels corresponding to the bits latched by the data latch 315. The bits having the signal levels that are adjusted by the level shifter 316 may be provided to the decoder 317.

The decoder 317 may receive the bits having the signal levels that are adjusted by the level shifter 316. The decoder 317 may process the gamma data GD based on the bits having the adjusted signal levels. Thus, the decoder 317 may generate a driving signal DRV. The driving signal DRV generated by the decoder 317 may be provided to the amplifying buffer 318. The amplifying buffer 318 may buffer and output the driving signal DRV generated by the decoder 317. The driving signal DRV that is output from the first driver cell 312_1 may be used to display an image on ones of the pixels constituting the display device.

Although described later, as an example embodiment, the decoder 317 may be disposed adjacent to one side of the first driver cell 312_1. That is, in some embodiments of the present disclosure, the shift register 314, the data latch 315, the level shifter 316, the decoder 317, and the amplifying buffer 318 may not be disposed in the order of signal flow. In this example embodiment, for instance, a signal flow path may have a shape which looks like a letter "U". According to this example embodiment, an area occupied by a metal line provided on an area on which a source driver circuit 310 (see FIG. 5) is disposed may be minimized. This example embodiment will be further described later with reference to FIGS. 8 and 9.

FIG. 7 is just a conceptual diagram to help understanding of the configuration of the first driver cell 312_1. The first driver cell 312_1 may have a different configuration from that described in FIG. 7. For instance, the first driver cell 312_1 may further include a multiplexer in order to reduce complexity of line connection. The configuration of the first driver cell 312_1 may be variously changed or modified, as necessary. FIG. 7 is not intended to limit the configuration of the first driver cell 312_1.

Figure 8:
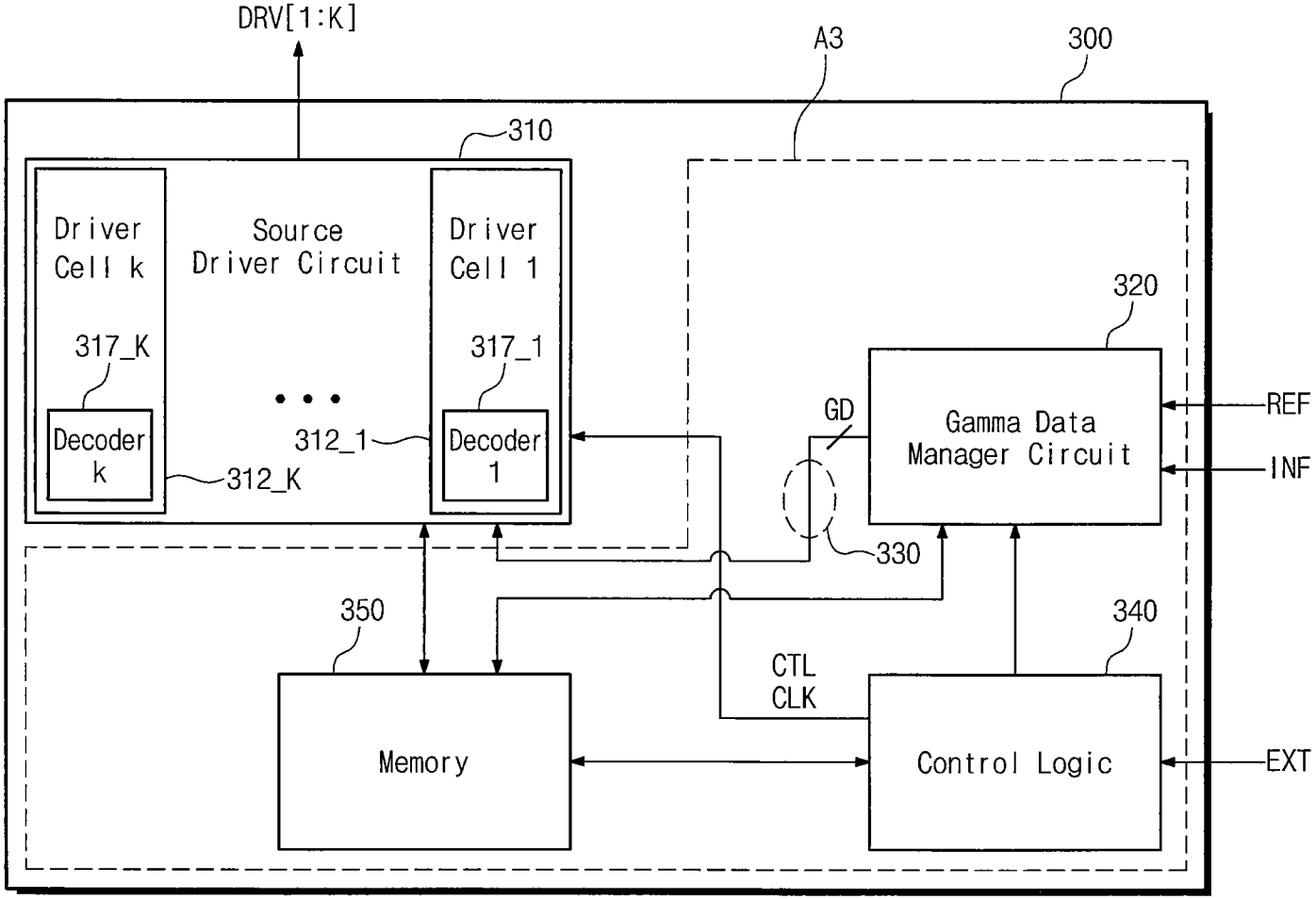
FIG. 8 is a block diagram illustrating a display driver integrated circuit chip according to some embodiments of the present disclosure.

FIG. 8 is a block diagram illustrating a DDI chip 300 according to some embodiments of the present disclosure. In particular, FIG. 8 shows a case that the DDI chip 300 of FIG. 5 includes the source driver circuit 310 of FIGS. 6 and 7. Therefore, detailed descriptions duplicated with the descriptions for FIGS. 5 to 7 will be omitted below for brevity of the description. Referring to FIG. 8, the DDI chip 300 may include a source driver circuit 310, a gamma data manager circuit 320, control logic 340, and a memory 350. In particular, the gamma data manager circuit 320, the control logic 340, and the memory 350 may be disposed on a third area A3, which is an area where the source driver circuit 310 is not disposed.

The source driver circuit 310 may include a plurality of driver cells 312_1 to 312_K. The driver cells 312_1 to 312_K may include decoders 317_1 to 317_K, respectively. As an example embodiment, the decoders 317_1 to 317_K that are respectively included in the driver cells 312_1 to 312_K may be disposed adjacent to the third area A3.

As described with reference to FIG. 4, when the decoders 317_1 to 317_K are disposed adjacent to the third area A3, a distance between each of the decoders 317_1 to 317_K and a metal line provided on the third area A3 may be shortened. Thus, according to the above example embodiment, an area occupied by a metal line provided on an area on which the source driver circuit 310 is disposed among the gamma signal line 330 may be reduced. As a result, when the decoders 317_1 to 317_K are disposed adjacent to the third area A3, the area on which the source driver circuit 310 is disposed may decrease, and height of the source driver circuit 310 may also decrease. Thus, length of a shorter side of the DDI chip 300 may decrease, and a production efficiency of the DDI chip 300 may be improved.

FIG. 8 is just a conceptual diagram to help understanding of the configuration of the DDI chip 300. FIG. 8 is not intended to limit the configuration of the DDI chip 300. The DDI chip 300 may have a different configuration from that described in FIG. 8.

Figure 9:
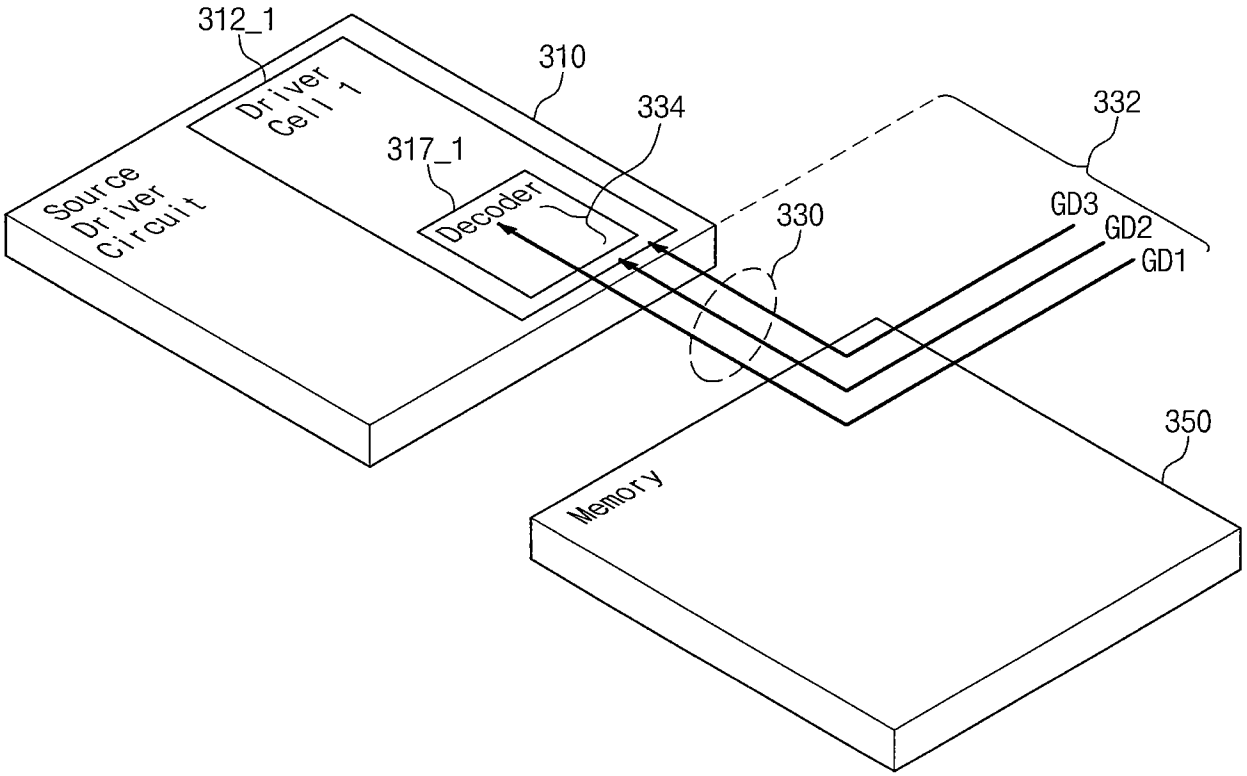
FIG. 9 is a conceptual diagram illustrating a connection between a source driver circuit, a gamma signal line, and a memory shown in FIG. 8 according to some embodiments of the present disclosure.

FIG. 9 is a conceptual diagram illustrating a connection between a source driver circuit 310, a gamma signal line 330, and a memory 350 shown in FIG. 8 according to some embodiments of the present disclosure. For brevity of the description, some components included in the DDI chip 300 are omitted in FIG. 9.

The source driver circuit 310 may include a first driver cell 312_1. The first driver cell 312_1 may include a decoder 317_1. As an example embodiment, the decoder 317_1 may be disposed adjacent to an area other than an area on which the source driver circuit 310 is disposed. In particular, the decoder 317_1 may be disposed adjacent to an area on which the memory 350 is disposed. In this example embodiment, a metal line 332, among the gamma signal line 330, provided on the area other than the area on which the source driver circuit 310 is disposed may be provided on the area on which the memory 350 is disposed. In addition, the gamma signal line 330 may include a metal line 334 provided on the area on which the source driver circuit 310 is disposed, particularly, on the area on which the decoder 317_1 is disposed.

Referring to FIGS. 2 and 9, as an example embodiment, the element 250 may include the memory 350. That is, the silicon area SA2 and metal lines that are provided on the second silicon area SA2 and are included in the first metal layer ML1 to the $(n-2)^{th}$ metal layer ML(n−2) may be configured to perform a function of the memory 350. As an example embodiment, the second metal lines MN2 may not be included in the memory 350. When the second metal lines MN2 are included in the gamma signal line 330, the gamma signal line 330 may not be wholly provided on the area on which the source driver circuit 310 is disposed. Thus, when the second metal lines MN2 not included in the memory 350 are used as the gamma signal line 330, an area occupied by the source driver circuit 310 may be reduced.

In addition, when the decoder 317_1 receiving first gamma data GD1 to third gamma data GD3 is disposed adjacent to the area on which the memory 350 is disposed, an area occupied by the metal line 334 provided on the area on which the source drive circuit 310 is disposed may be minimized. That is, according to some embodiments of the present disclosure, height of the source driver circuit 310 may decrease, and length of a shorter side of the DDI chip 300 may decrease. In an example embodiment, the first gamma data GD1 to the third gamma data GD3 may be transmitted to the source driver circuit 310 along the metal line 332 (i.e., the second metal line MN2) provided on the area on which the memory 350 is disposed and along the metal line 334 provided on the area on which the decoder 317_1 is disposed.

Figure 10:
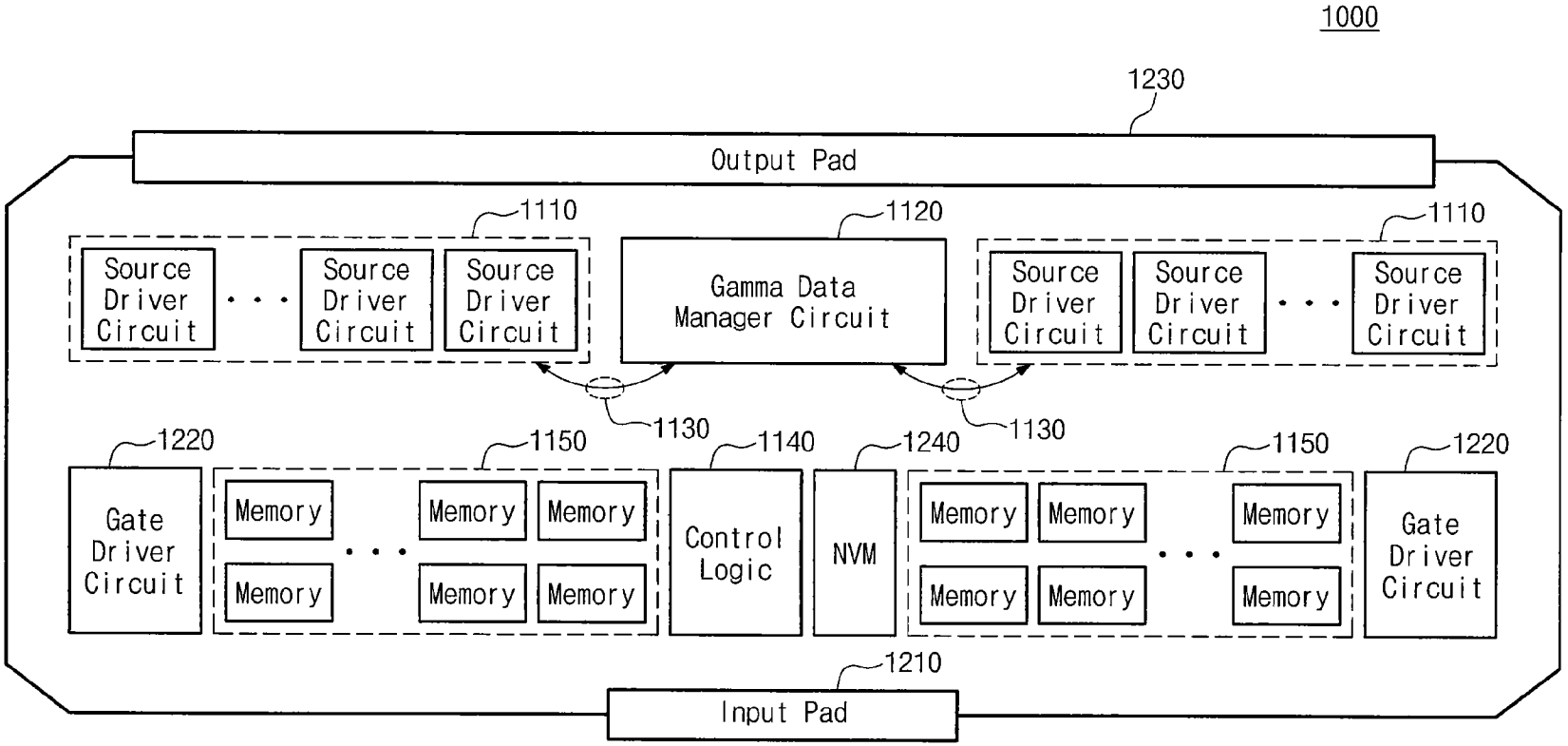
FIG. 10 is a block diagram illustrating a display driver integrated circuit chip according to some embodiments of the present disclosure.

FIG. 10 is a block diagram illustrating a DDI chip 1000 according to some embodiments of the present disclosure. Referring to FIG. 10, the DDI chip 1000 may include one or more source driver circuits 1110, a gamma data manager circuit 1120, control logic 1140, one or more memories 1150, an input pad 1210, one or more gate driver circuits 1220, an output pad 1230, and a nonvolatile memory 1240.

Each of the source driver circuits 1110 may correspond to the source driver circuit 110, 210 or 310 described with reference to FIGS. 1 to 9. The gamma data manager circuit 1120 may correspond to the gamma data manager circuit 320 described with reference to FIG. 5. The control logic 1140 may correspond to the control logic 340 described with reference to FIG. 5. Each of the memories 1150 may correspond to the memory 350 described with reference to FIGS. 5 to 9.

Each of the source driver circuits 1110 may receive gamma data from the gamma data manager circuit 1120 through gamma signal lines 1130. According to some embodiments of the present disclosure, the gamma signal lines 1130 may include a metal line provided on an area other than an area on which the source driver circuits 1110 are disposed. Thus, height of each of the source driver circuits 1110 may decrease, and an area occupied by the source driver circuits 1110 may also decrease. As a result, length of a shorter side of the DDI chip 1000 may decrease, and a production efficiency of the DDI chip 1000 may be improved.

As an example embodiment, the gamma signal lines 1130 may further include a metal line provided on an area on which the source driver circuits 1110 are disposed. Gamma data may be transmitted from the gamma data manager circuit 1120 to the source driver circuits 1110 along the metal line provided on the area other than the area on which the source driver circuits 1110 are disposed and along the metal line provided on the area on which the source driver circuits 1110 are disposed.

As an example embodiment, decoders included in the source driver circuits 1110 may be disposed adjacent to the area other than the area on which the source driver circuits 1110 are disposed. In particular, the decoders may be disposed adjacent to the area on which the memories 1150 are disposed. In this example embodiment, a distance between the decoders and the memories 150 may be reduced. Thus, an area occupied by the metal lines provided on the area on which the source driver circuits 1110 are disposed may be minimized.

The source driver circuits 1110, the gamma data manager circuit 1120, the gamma signal lines 1130, the control logic 1140, and the memories 1150 may be implemented based on the example embodiments described with reference to FIGS. 1 to 9. Thus, redundant descriptions associated with the source driver circuits 1110, the gamma data manager circuit 1120, the gamma signal lines 1130, the control logic 1140, and the memories 1150 will be omitted below for brevity of the description.

The input pad 1210 may receive a signal from an exterior of the DDI chip 1000. The received signal through the input pad 1210 may be provided to other components of the DDI chip 1000. The gate driver circuits 1220 may provide a gating signal to a pixel row of a display device. The gating signal may be used to drive the display device together with a driving signal generated by the source driver circuits 1110.

The driving signal that is output from the source driver circuits 1110 and the gating signal that is output from the gate driver circuit 1220 may be transmitted to an exterior of the DDI chip 1000 through the output pad 1230. Pixels constituting a display device may receive the driving signal and the gating signal through the output pad 1230. The pixels constituting the display device may display images in response to the driving signal and the gating signal.

The nonvolatile memory 1240 may store data used to operate the DDI chip 1000. In particular, the nonvolatile memory 1240 may store data that needs to be retained even when power is not supplied to the DDI chip 1000. For instance, the nonvolatile memory 1240 may be one of a flash memory, a PRAM, an MRAM, an ReRAM, an FRAM, and so on. Alternatively, the nonvolatile memory 1240 may be a one time programmable (OTP) memory.

The DDI chip 1000 may include a plurality of integrated circuits. The plurality of integrated circuits included in the DDI chip 1000 may be mounted on a single chip package. That is, the source driver circuits 1110, the gamma data manager circuit 1120, the gamma signal lines 1130, the control logic 1140, the memories 1150, the input pad 1210, the gate driver circuits 1220, the output pad 1230, and the nonvolatile memory 1240 may be mounted on the single chip package. As an example embodiment, the DDI chip may be mounted in the form of a chip-on-glass (COG) package or a chip-on-film (COF) package.

Figure 11:
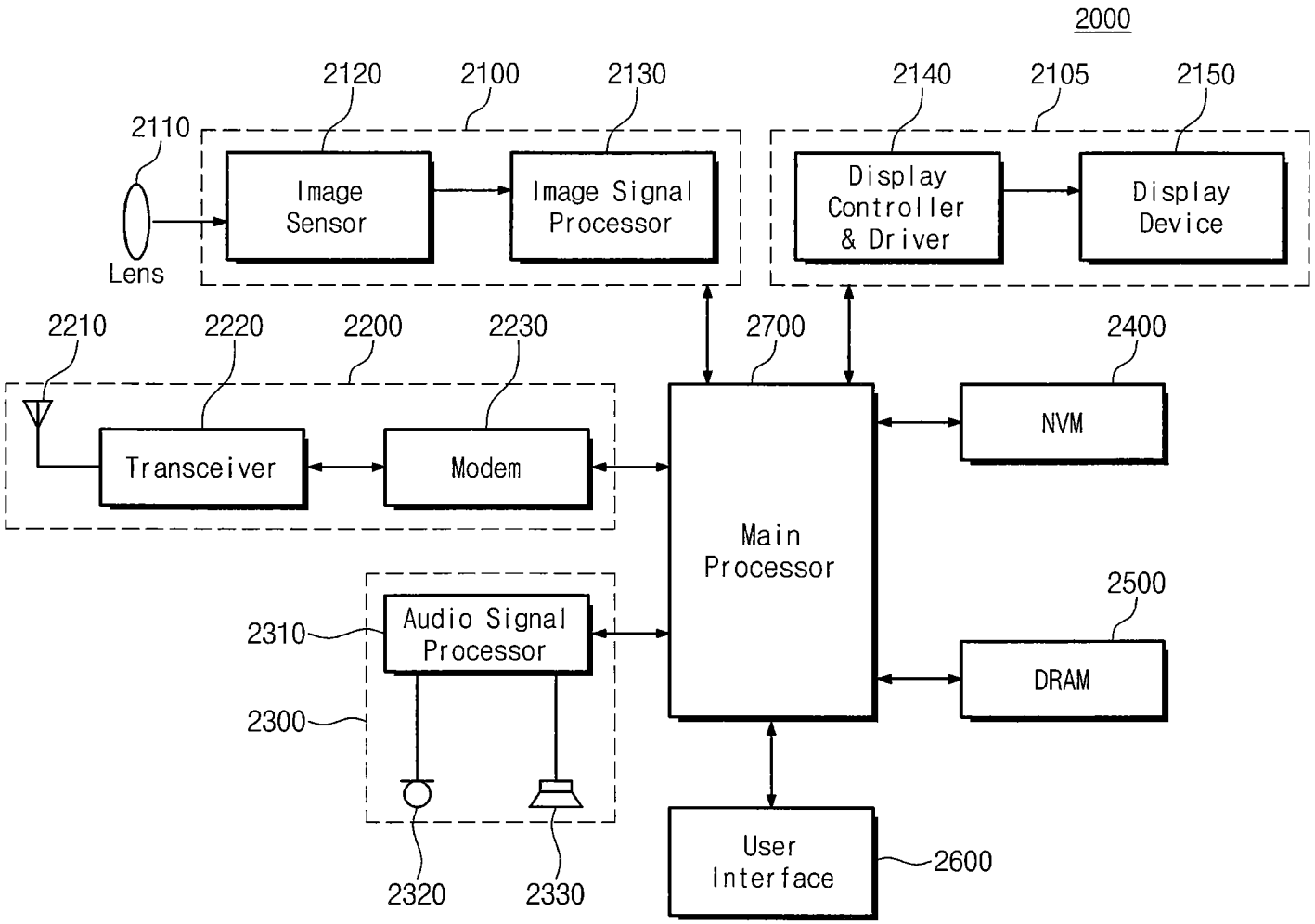
FIG. 11 is a block diagram illustrating a portable electronic device including a display driver integrated circuit chip according to some embodiments of the present disclosure.

FIG. 11 is a block diagram illustrating a portable electronic device 2000 including a DDI chip according to some embodiments of the present disclosure. Referring to FIG. 11, the portable electronic device 2000 may include an image processing unit 2100, an image display unit 2105, a wireless communication unit 2200, an audio processing unit 2300, a nonvolatile memory 2400, a DRAM 2500, a user interface 2600, and a main processor 2700. The portable electronic device 2000 may be one of a mobile terminal, a portable personal assistant (PDA), a personal media player (PMP), a smart phone, a tablet computer, a wearable device, and so on.

The image processing unit 2100 may receive light through a lens 2110. An image sensor 2120 and an image signal processor 2130 included in the image processing unit 2100 may generate an electronic image corresponding to the received light.

The image display unit 2105 may display an image. In particular, the display device 2150 may display an image according to the control of a display controller and driver 2140. For instance, the display device 2150 may display an image in response to a driving signal and a gating signal received from the display controller and driver 2140. As an example embodiment, the display device 2150 may be one of a liquid crystal display (LCD), an organic light emitting diode (OLED) display, an active matrix OLED (AMOLED) display, an LED, and so on.

The display controller and driver 2140 may be implemented in the form of a DDI chip according to some embodiments of the present disclosure. That is, the display controller and driver 2140 may be the DDI chip 100, 200, 300 or 1000 described with reference to FIGS. 1 to 10. The display controller and driver 2140 may process gamma data to generate the driving signal. According to some embodiments of the present disclosure, a gamma signal line used to transmit the gamma data may include a metal line provided on an area other than an area on which a source driver circuit is disposed.

The wireless communication unit 2200 may include an antenna 2210, a transceiver 2220, and a modem 2230. The wireless communication unit 2200 may communicate with an exterior of the portable electronic device 2000 based on one or more of wireless communication protocols, such as long term evolution (LTE), worldwide interoperability for microwave access (WiMax), global system for mobile communication (GSM), code division multiple access (CDMA), Bluetooth, near field communication (NFC), wireless fidelity (WiFi), radio frequency identification (RFID), and so on.

The audio processing unit 2300 may process an audio signal with using an audio signal processor 2310, a microphone 2320, and a speaker 2330. The nonvolatile memory 2400 may store data that needs to be retained regardless of power supply. As an example embodiment, the nonvolatile memory 2400 may include one or more of a flash memory, a PRAM, an MRAM, an ReRAM, an FRAM, and so on. Alternatively, the nonvolatile memory 2400 may include different types of memories. The DRAM 2500 may temporarily store data used to operate the portable electronic device 2000. The DRAM 2500 may be used as a working memory, an operation memory, a buffer memory, or the like of the portable electronic device 2000. As necessary, the DRAM 2500 may be replaced with an SRAM.

The user interface 2600 may relay communication between a user and the portable electronic device 2000 according to the control of the main processor 2700. For instance, the user interface device 2600 may include input interfaces, such as a keyboard, a keypad, a button, a touch panel, a touch screen, a touch ball, a touch pad, a camera, a microphone, a gyroscope sensor, a vibration sensor, and so on. The user interface 2600 may further include output interfaces, such as a display device, a motor, and so on.

The main processor 2700 may control the overall operations of the portable electronic device 2000. The image processing unit 2100, the wireless communication unit 2200, the audio processing unit 2300, the nonvolatile memory 2400, and the DRAM 2500 may execute a user command provided through the user interface 2600 according to the control of the main processor 2700. Alternatively, the image processing unit 2100, the wireless communication unit 2200, the audio processing unit 2300, the nonvolatile memory 2400, and the DRAM 2500 may provide information to a user through the user interface 2600 according to the control of the main processor 2700.

The main processor 2700 may be implemented by a system-on-chip (SOC). As an example embodiment, the main processor 2700 may include an application processor (AP).

Processors, memories, and circuits according to embodiments of the present disclosure may be mounted in various types of packages. For instance, a DDI chip according to some embodiments of the present disclosure may be packaged by one or more of a package on package (PoP), ball grid arrays (BGAs), chip scale packages (CSPs), a plastic leaded chip carrier (PLCC), a plastic dual in-line package (PDIP), a die in waffle pack, a die in wafer form, a chip on board (COB), a ceramic dual in-line package (CERDIP), a metric quad flat pack (MQFP), a thin quad flat pack (TQFP), a small outline integrated circuit (SOIC), a shrink small outline package (SSOP), a thin small outline package (TSOP), a system in package (SIP), a multi chip package (MCP), a wafer-level fabricated package (WFP), a wafer-level processed stack package (WSP), and so on.

As described above, an area occupied by a gamma signal line provided on an area on which a source drive circuit is disposed may be reduced. Thus, height of the source driver circuit may decrease, and length of a shorter side of a DDI chip may decrease. As a result, a production efficiency of the DDI chip may be improved.

A configuration illustrated in each conceptual diagram should be understood just from a conceptual point of view. Shape, structure, and size of each component illustrated in each conceptual diagram are exaggerated or downsized for understanding of the present disclosure. An actually implemented configuration may have a physical shape different from a configuration of each conceptual diagram. The present disclosure is not limited to a physical shape or size illustrated in each conceptual diagram.

The device configuration illustrated in each block diagram is provided to help understanding of the present disclosure. Each block may include smaller blocks according to functions. Alternatively, a plurality of blocks may form a larger block according to a function. That is, the present disclosure is not limited to the components illustrated in each block diagram.

While the present disclosure has been particularly shown and described with reference to example embodiments thereof, the present disclosure is not limited to the above-described example embodiments. It will be understood by those of ordinary skill in the art that various changes and variations in form and details may be made therein without departing from the spirit and scope of the present disclosure as defined by the following claims.

What is claimed is:

1. A display driver integrated circuit chip comprising:

a source driver circuit on a first area of the display driver integrated circuit chip, the source driver circuit being configured to process gamma data corresponding to an image that is to be displayed on a display device and configured to generate a driving signal in response to a control signal and a clock signal;

a gamma data manager circuit configured to provide the gamma data to the source driver circuit, the gamma data being generated based on a gamma reference signal that defines a reference voltage level and a gamma information signal that defines the gamma data when compared to the gamma reference signal;

a control logic circuit configured to provide the control signal and the clock signal to the source driver circuit; and a memory configured to store operation data used to operate the source driver circuit, the gamma data manager circuit, and the control logic circuit, wherein a gamma signal line used to transmit the gamma data from the gamma data manager circuit to the source driver circuit comprises a first metal line extending in a first direction from the first area to a second area other than the first area and comprises a second metal line extending on the second area in a second direction that is different from the first direction, wherein the second metal line is electrically connected to the first metal line, and wherein a length of the first metal line in the first direction is less than a length of the second metal line in the second direction.

2. The display driver integrated circuit chip of claim 1, wherein a portion of the second metal line extends on a third area on which the memory is disposed.

3. The display driver integrated circuit chip of claim 1, wherein the source driver circuit comprises a plurality of driver cells, and wherein each of the plurality of driver cells comprises:

a shift register configured to sequentially output bits included in the control signal in response to the clock signal;

a data latch configured to latch the bits sequentially output from the shift register;

a level shifter configured to receive the latched bits, and to adjust signal levels corresponding to the received bits;

a decoder configured to process the gamma data and to generate the driving signal based on the bits having the adjusted signal levels; and an amplifying buffer configured to buffer and output the generated driving signal.

4. The display driver integrated circuit chip of claim 3, wherein the decoder is disposed on a third area that is adjacent to the second area, the third area being within the first area.

5. The display driver integrated circuit chip of claim 4, wherein the decoder is disposed adjacent to a fourth area on which the memory is disposed, the fourth area being within the second area.

6. The display driver integrated circuit chip of claim 5, wherein a portion of the second metal line provided on the second area is provided on the fourth area on which the memory is disposed, wherein a portion of the first metal line provided on the first area is provided on the third area on which the decoder is disposed, and wherein the gamma data is configured to be transmitted along the portion of the second metal line provided on the fourth area on which the memory is disposed and along the portion of the first metal line provided on the third area on which the decoder is disposed.

7. The display driver integrated circuit chip of claim 1, further comprising a gate driver circuit configured to generate a gating signal used to drive the display device together with the driving signal.

8. The display driver integrated circuit chip of claim 7, wherein the source driver circuit, the gamma data manager circuit, the control logic circuit, the memory, and the gate driver circuit are mounted together on a single chip package.

9. A display driver integrated circuit chip comprising:

a silicon layer;

a plurality of metal layers provided on the silicon layer;

a source driver circuit on a first silicon area of the silicon layer, the source driver circuit being configured to process gamma data corresponding to an image that is to be displayed on a display device, the source driver circuit including first metal lines, the first metal lines being included in the plurality of metal layers and being provided on the first silicon area; and a gamma signal line used to transmit the gamma data to the source driver circuit, wherein the gamma signal line comprises second metal lines, the second metal lines being provided on a second silicon area other than the first silicon area of the silicon layer and the second metal lines being included in the plurality of metal layers, wherein the first metal lines extend in a first direction from the first silicon area to the second silicon area, wherein the second metal lines extend in a second direction that is different from the first direction and are connected to respective ones of the first metal lines, and wherein a length of the first metal lines in the first direction is less than a length of the second metal lines in the second direction.

10. The display driver integrated circuit chip of claim 1, wherein the source driver circuit, the gamma data manager circuit, the control logic circuit, and the memory are on a single chip package that comprises a first length in the first direction and a second length in the second direction, the first length being less than the second length.

11. The display driver integrated circuit chip of claim 9, wherein the second metal lines comprise a first layer metal line of a first metal layer that is farthest away from the silicon layer among the plurality of metal layers.

12. The display driver integrated circuit chip of claim 11, wherein the second metal lines further comprise a second layer metal line of a second metal layer among the plurality of metal layers, the second metal layer being closest to the first metal layer, and wherein the first layer metal line of the first metal layer is connected to the second layer metal line of the second metal layer through a via.

13. The display driver integrated circuit chip of claim 12, wherein the gamma signal line further comprises a third metal line of the second metal layer being provided on the first silicon area.

14. The display driver integrated circuit chip of claim 13, wherein the gamma data is configured to be transmitted to the source driver circuit along the first layer metal line of the first metal layer, the via, the second layer metal line of the second metal layer, and the third metal line.

15. The display driver integrated circuit chip of claim 9, wherein the source driver circuit and the gamma signal line are mounted together on a single chip package.

16. The display driver integrated circuit chip of claim 9, wherein the silicon layer comprises a first length in the first direction and a second length in the second direction, the first length being less than the second length.

17. A portable electronic device comprising:

an image processing unit;

an image display unit including a display device and a display driver;

a wireless communication unit;

an audio processing unit;

a nonvolatile memory;

a volatile memory;

a user interface; and a main processor, wherein the display driver is configured to control the display device, and wherein the display driver comprises:

a source driver circuit on a first area of the display driver, the source driver circuit being configured to process gamma data corresponding to an image that is to be displayed on the display device and configured to generate a driving signal in response to a control signal and a clock signal;

a gamma data manager circuit configured to provide the gamma data to the source driver circuit, the gamma data being transmitted through a gamma signal line, the gamma signal line comprising a first metal line extending in a first direction from the first area to a second area other than the first area and comprising a second metal line extending on the second area in a second direction that is different from the first direction, wherein a length of the first metal line in the first direction is less than a length of the second metal line in the second direction; and a control logic circuit configured to provide the control signal and the clock signal to the source driver circuit.

18. The portable electronic device of claim 17, wherein the source driver circuit comprises a plurality of driver cells, and wherein each of the plurality of driver cells comprises a decoder configured to process at least a portion of the gamma data based on the control signal provided from the control logic circuit.

19. The portable electronic device of claim 17, wherein the display driver includes a gate driver circuit configured to generate a gating signal used to drive the display device together with the driving signal.

20. The portable electronic device of claim 17, wherein the display driver comprises a single chip package that comprises a first length in the first direction and a second length in the second direction, the first length being less than the second length.

* * * * *